US011097172B2

(12) United States Patent
Diepenbrock, Jr. et al.

(10) Patent No.: US 11,097,172 B2
(45) Date of Patent: Aug. 24, 2021

(54) WEIGHTING SYSTEM FOR PUTTER TYPE GOLF CLUB

(71) Applicants: William R. Diepenbrock, Jr., St. Louis, MO (US); Jeffery D. Sheets, Buda, TX (US)

(72) Inventors: William R. Diepenbrock, Jr., St. Louis, MO (US); Jeffery D. Sheets, Buda, TX (US)

( * ) Notice: Subject to any disclaimer, the term of this patent is extended or adjusted under 35 U.S.C. 154(b) by 0 days.

(21) Appl. No.: 17/002,880

(22) Filed: Aug. 26, 2020

(65) Prior Publication Data

US 2020/0384324 A1 Dec. 10, 2020

Related U.S. Application Data

(63) Continuation-in-part of application No. 16/179,981, filed on Nov. 4, 2018, now abandoned.

(51) Int. Cl.

| | |
|---|---|
| ***A63B 53/00*** | (2015.01) |
| ***A63B 60/04*** | (2015.01) |
| ***A63B 60/24*** | (2015.01) |

(52) U.S. Cl.

CPC ..... *A63B 60/04* (2015.10); *A63B 53/007* (2013.01); *A63B 60/24* (2015.10)

(58) Field of Classification Search

CPC ..... A63B 60/04; A63B 53/007; A63B 60/24; A63B 53/14; A63B 2209/10; A63B 60/54; A63B 60/02

See application file for complete search history.

(56) References Cited

U.S. PATENT DOCUMENTS

| | | | | | |
|---|---|---|---|---|---|
| 4,461,479 | A * | 7/1984 | Mitchell | A63B 60/24 | 473/292 |
| 5,478,074 | A * | 12/1995 | Storper | A63B 53/14 | 473/299 |
| 5,575,473 | A * | 11/1996 | Turner | A63B 53/007 | 473/298 |
| 7,140,973 | B2 * | 11/2006 | Rohrer | A63B 53/14 | 473/300 |
| 8,062,148 | B1 * | 11/2011 | Farkas | A63B 53/0487 | 473/313 |
| 9,174,104 | B1 * | 11/2015 | Rogacki | A63B 60/30 | |
| 9,604,108 | B1 * | 3/2017 | Dunnell | A63B 60/02 | |
| 10,130,858 | B2 * | 11/2018 | Lamkin | A63B 60/10 | |
| 2002/0173377 | A1 * | 11/2002 | Sindelar | A63B 53/007 | 473/340 |
| 2006/0019765 | A1 * | 1/2006 | Plutt | A63B 53/007 | 473/297 |
| 2014/0100054 | A1 * | 4/2014 | Parente | A63B 60/10 | 473/292 |
| 2016/0051863 | A1 * | 2/2016 | Diepenbrock | A63B 53/14 | 473/300 |

* cited by examiner

*Primary Examiner* — Stephen L Blau
(74) *Attorney, Agent, or Firm* — N. J. Aquilino

(57) ABSTRACT

A weight system for a putter type golf club that creates a balance point close to a golfer's hands when the putter is used in a normal manner for execution of a putting stroke. The putter is formed of a putter head, an elongated, constant ¼ inch diameter solid metal shaft; and a weighted, cylindrical adapter attached to an upper section of the elongated shaft between an overlying golf grip and the shaft.

4 Claims, 1 Drawing Sheet

WEIGHTING SYSTEM FOR PUTTER TYPE GOLF CLUB

RELATED APPLICATIONS

This application is a continuation in part of application Ser. No. 16/179,981 filed Nov. 4, 2018 for Putter Type Golf Club

BACKGROUND OF THE INVENTION

The present invention relates to golf putters and in particular to a golf putter having a unique weight assembly for use with a small diameter, solid steel shaft creating enhanced stability during a putting stroke.

When playing the game of golf, it is important and necessary for the golfer to have consistent feel when striking a golf ball in order to produce repeatable golf shots to insure a golf ball travels precise distances and to the desired location. While this is true for all types of golf shots, it is particularly true for golf shots struck with a putter type golf club where the impact force against the golf ball is significantly less than full swing golf shots. Typically, amateur golfers miss hit a golf ball away from the precise center of percussion of a golf putter a large percentage of the time. A typical golfer will miss-hit the golf ball more often during a round of golf as the golfer's handicap rises. This is particularly true with older golfers whose physical abilities have declined with age with the result that the golfer's feel is greatly diminished.

SUMMARY OF THE INVENTION

The putter of the present invention is radically different from putters that are currently available in the marketplace that use hollow shafts. The putter of the present invention uses a solid steel shaft having a diameter of ¼ inch extending between a blade putter head that is lighter than conventional putter heads of similar shape and an upper butt end of the golf club. The putter head weighs less than the weight of most conventional putter heads that typically weigh between 335 and 370 grams. The shaft weighs at least and preferably more than twice the weight of conventional putter shafts that typically weigh approximately 100 grams. The weighting system of the putter includes an upper weighted, cylindrical adapter at the upper end of the small diameter, steel shaft. The weight system positions the balance point of the putter significantly higher toward the upper butt end of the putter closer to the golfer's hands. This balance point location allows the golfer to have more control of the putter during the execution of a putting stroke.

A conventional slip-on golf grip is attached to the upper butt end of the putter using the upper weighted adapter as a support for the grip to complete the structure of the putter. The length of the weighted adapter is at least the same size as the length of a conventional grip and preferably slightly longer and having at least a length of 11 inches, the size of most conventional golf grips. The adapter is formed with an internal bore of approximately ¼ inch along the entire length thereof in order that it snugly fits over the ¼ inch shaft when the putter is assembled. The weight of the adapter is slightly less than half the weight of the shaft, preferably approximately 40% of the shaft weight. In combination with the weight of the grip, the weighted adapter locates a longitudinal balance point of the putter from a normal distance approximately 35% of the length of the putter from the putter head toward the butt end of the club to an improved location approximately 60% of the length of the putter from the putter head. The higher balance point on the shaft of the putter closer to the golfer's hands allows the golfer to have more control of the putting stroke as compared with putters that have a balance point lower toward the putter head.

A typical embodiment of a putter of the present invention weighs approximately 740 grams and is formed by a head having a weight no greater than 310 grams, a steel shaft of approximately 250 grams and a cylindrical, weighted adapter of approximately 100 grams and a grip between 75 and 125 grams. The weight of the adapter preferably is approximately 40% of the weight of the steel shaft.

Typically the weighted, cylindrical adapter is a milled aluminum cylinder measuring at least 11 inches in length with a fixed tip reducer on the lower end that tapers down toward the diameter of the ¼ inch shaft. The weighted adapter has a central bore approximately ¼ inch in diameter in order to fit over the ¼ inch steel shaft when the adapter is assembled, preferably using a double sided adhesive tape or other adhesive material. The outer circumference of the weighted adapter is sized to fit into the axial opening of a conventional, slip-on golf grip to complete the structure of the putter. The additional weight of the adapter at the upper end of the shaft of the putter, along with the grip, locates the balance point upwardly closer to the golfer's hands as described above.

The putter shaft with a solid steel core and the weight distribution of the components of the putter result in the head feeling lighter with more feel and reduces vibration and torque when the golf ball is not hit in the exact center of percussion of the striking face. The increased weight of the solid rod all the way to the upper end of the putter and the additional weight of the weighted adapter that typically is under a golfer's hands, in combination with a putter head weight lighter than the majority of conventional putters, moves the balance point closer to the golfer's hands creating more control that, in turn, makes it easier for a golfer to keep the club head on line during a putting stroke.

In summary, the putter of the present invention is made with four separate components that are assembled to operate together that creates the putter. The components include a putter head connected to an elongated, solid, rigid stainless-steel shaft extending the entire length of the club. An upper weight member in the form of a cylindrical adapter is sized to fit over the upper end of the stainless-steel shaft. A conventional golf grip that fits over the adapter to complete the putter.

Among the objects of the present invention is the provision of a putter type golf club formed of a solid and rigid shaft structure and upper weighted adapter that is balanced to promote stability and feel in a golfer's hands when executing a putting stroke.

Another object of the present invention is the provision of a putter type golf club having a solid steel shaft in combination with a unique weighting assembly that locates the balance point of the putter close to the golfer's hands.

Still another object of the present invention is the provision of a putter type golf club having reduced vibration during the strike of a golf ball and a more solid feel providing feedback to the golfer striking a golf ball during a normal putting stroke.

These and other objects of the present invention will be apparent with reference to the following specification and accompanying drawings.

DESCRIPTION OF A PREFERRED EMBODIMENT

Figure 1:
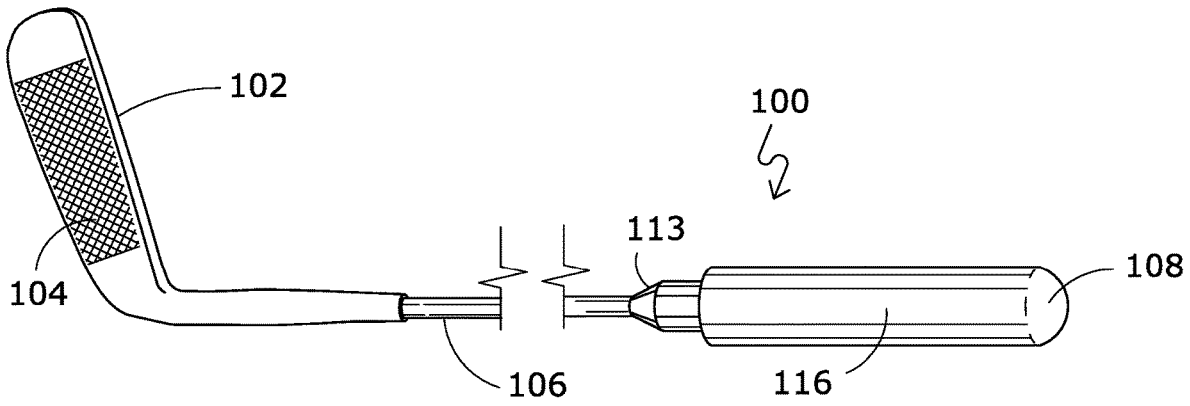
FIG. 1 is a perspective view of the golf putter of the present invention.
Figure 2:
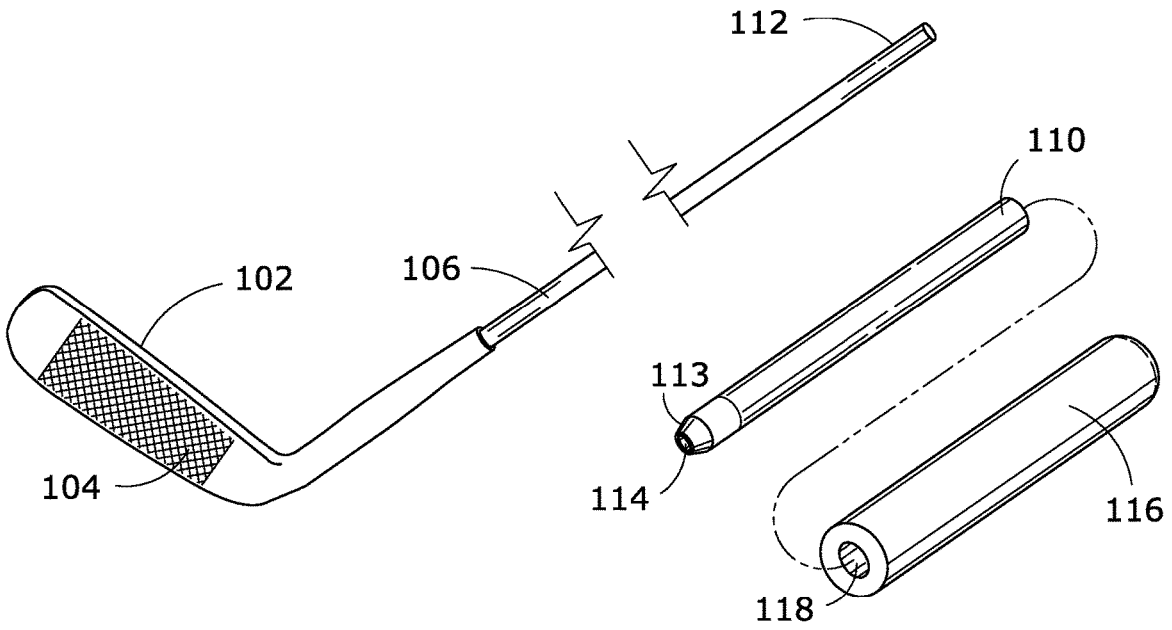
FIG. 2 is an exploded view of the putter of FIG. 1.

The drawings show a golf putter 100 of the present invention. The putter has four main parts, a conventional club head 102, with a striking face 104, an elongated shaft 106, an upper weighted, cylindrical adapter 110 and a conventional grip 116. The head 102 and shaft 106 are connected in a conventional way by insertion of the shaft 106 directly into the head 102 or by using a hosel, not shown. Preferably the shaft 106 is generally cylindrical and is made of solid, rigid stainless steel having a ¼ inch diameter extending between the head 102 and an upper end 108 of the putter 100.

The head 102 may be any shape such as a blade, mallet or similar conventional shape as an example. It will be appreciated the putter head may include separate structures, such as weight members or face inserts, while maintaining a conventional structure.

The upper weighted, cylindrical adapter 110 has a length of approximately 10-11 inches that extends slightly beyond the end of the golf grip 116 when assembled. The adapter 110 is attached to an upper section 112 of the shaft 106 between the upper end 108 downwardly toward the head 102. The weighted adapter 110 is formed with an approximate ¼ inch bore 111 that extends the entire length of the adapter 110 with openings at opposite ends thereof. The adapter bore 111 is approximately the same size as the diameter of the shaft 106 in order to fit over the shaft 106 when the components of the putter 100 are assembled. The outer surface of the weighted adapter 110 is also generally cylindrical and is sized to be inserted into an inner shaft opening 118 of a conventional golf grip 116 when the putter 100 is assembled. The adapter 110 includes a flared end 113 forming a smooth transition with the shaft 106 when the putter 100 is assembled. The weighted adapter 110 provides a solid connection under the entire length of the grip 116 between the grip 116 and the shaft 106 that reduces vibration, twisting and torqueing particularly when a golf ball is not struck precisely at the center of percussion of the club head 102. The weight of at least 100 grams of the adapter 110 is approximately 40% of the total weight of the 250 gram shaft. The weight of the weighted cylindrical adapter 110, in combination with the weight of the golf grip 116, locates a longitudinal balance point of the putter 100 on the shaft 106 up to 60% of the distance between the bottom of the putter head 102 and the upper end 108 of the putter 100 close to a normal position of a golfer's hands.

Typically, an adhesive type material or double-sided tape is used to secure the weighted adapter 110 to the shaft 106 and to fit the grip 116 onto the weighted adapter 110.

The putter 100 of this invention uses a putter head 102 that weighs no greater than 310 grams. The shaft 106 attached to the putter head 102 weighs approximately 250 grams whereby the overall weight of the head 102 and shaft 106 is greater than 500 grams. When the weighted adapter 110 of approximately 100 grams and a grip 116, that typically weighs between 75 and 125 grams is attached, the putter 100 of the present invention will have an overall weight greatly exceeding 500 grams as compared to conventional putters that typically weigh less than 500 grams. Even with this weight differential, the location of the balance point of the putter 100 near the golfer's hands provides a generally normal feel to the golfer when executing normal putting strokes.

In addition, the dynamics of the distribution of the weights in the head, shaft and cylindrical adapter allows the golfer to maintain the putter in alignment during a putting stroke by maintaining stability of the putter in both the back stroke and follow through stroke hitting the golf ball.

All of the various weighted parts are combined to operate in unity and to create the dynamics of a balanced putter having the advantages described above. It will be appreciated that the weights may be varied heavier or lighter with the ratios remaining relatively constant in keeping within the spirit, intent and scope of the present invention

The invention claimed is:

1. A weight system for a putter type golf club having a unitary putter head weighing up to and no greater than 310 grams, an elongated, constant diameter, rigid and solid steel shaft integrally connected to the putter head; said shaft weighing approximately 250 grams; and a golf grip, wherein the improvement comprises: a upper weighted adapter attached to an upper section of said elongated shaft; said weighted adapter having an outer circumference and an inner bore along the entire length thereof sized to fit over and connect to said shaft; said weighted adapter having a weight of at least 100 grams; whereby said putter is further defined as having a longitudinal balance point between an upper butt end and a bottom of said club head that is located approximately 60% of the distance therebetween toward said upper butt end.

2. The weight system for a putter type golf club of claim 1 wherein said weighted adapter is cylindrical in shape and has a length defined as at least as long as the length of said golf grip.

3. The weight system for a putter type golf club of claim 2 wherein said elongate shaft has a constant diameter along the length thereof of approximately ¼ inch and said inner bore of said adapter is approximately ¼ inch.

4. The putter type golf club of claim 1 wherein said weighted adapter weighs approximately 40% of the weight of the shaft.

* * * * *